United States Patent [19]

Pausch

[11] Patent Number: 4,562,885

[45] Date of Patent: Jan. 7, 1986

[54] PLATE HEAT EXCHANGER AND PRESSURE BLAST CLEANER

[75] Inventor: Josef Pausch, Minnetonka, Minn.

[73] Assignee: General Resource Corporation, Hopkins, Minn.

[21] Appl. No.: 526,972

[22] Filed: Aug. 29, 1983

[51] Int. Cl.[4] ..... F28G 7/00

[52] U.S. Cl. ..... 165/84; 15/316 A; 165/95; 165/908

[58] Field of Search ..... 165/95, 5, 84, 101, 165/DIG. 11; 15/316 A

[56] References Cited

U.S. PATENT DOCUMENTS

| | | | |
|---|---|---|---|
| 3,042,382 | 7/1962 | Hryniszak | 165/95 X |
| 3,364,983 | 1/1968 | Krinov et al. | 165/1 |
| 3,412,786 | 11/1968 | Taylor | 165/95 X |
| 4,025,362 | 5/1977 | Frauenfeld | 165/5 X |
| 4,095,349 | 6/1978 | Parker | 165/95 X |
| 4,141,754 | 2/1979 | Frauenfeld | 165/5 X |
| 4,366,003 | 12/1982 | Korte et al. | 165/1 X |

*Primary Examiner*—Sheldon J. Richter
*Assistant Examiner*—Randolph A. Smith
*Attorney, Agent, or Firm*—Paul L. Sjoquist

[57] ABSTRACT

A plate heat exchanger having a plurality of parallel channels for conveying heated gases including entrained pollutants, with transversely directed cooling gases intermediate the polluted gas channels, and an apparatus for periodically cleaning the polluted gas channels, including pipes aligned with their respective channel openings, the pipes having a plurality of jet passages closely spaced therealong, all of the pipes connected to a pressure accumulator having at least a volume greater than ten times the volume of an individual pipe interior, and including controllable valve release mechanisms for sequentially exhausting the pressure tank volume into each of the respective pipes.

5 Claims, 5 Drawing Figures

PLATE HEAT EXCHANGER AND PRESSURE BLAST CLEANER

BACKGROUND OF THE INVENTION

The present invention relates to plate-type heat exchangers, particularly heat exchangers for conveying polluted gases having solid materials entrained therein, and more specifically to a jet cleaning apparatus for use in conjunction with such heat exchangers.

Plate-type heat exchangers are well-known in the art, usually comprising a rectangular housing having a plurality of parallel, spaced-apart plates enclosed therein, opposite ends of parallel pairs of such plates along one axis being sealed together to form parallel flow channels, opposite ends of intermediate plates along a normal axis being sealed together to provide transverse flow channels through the intermediate end plates. Such devices typically provide a flow path through the plurality of channels for conveying heated and usually polluted gases, and consequent transverse paths through the intermediate channels for conveying a cooling gas, which cooling gas absorbs heat through contact with the plates, and emerges from the heat exchanger warmed to an elevated temperature, which heated gas may be reused in industrial processes. In such devices the parallel channels which convey the dirty gas tend to accumulate pollutants over time, the pollutants adhering to the walls and interior surfaces of the channels, thereby reducing the heat transfer efficiency of the apparatus and eventually clogging the free flow of gas therethrough. Frequently, clogged channels become the focus of heat build-up within the heat exchanger, which heat build-up can combine with the pollutants to corrode the heat exchanger material and eventually cause openings to erode into the clean gas channels, thereby destroying the effectiveness of the heat exchanger.

Various mechanical, liquid and pneumatic devices have been used in the past to clean the flow channels of such heat exchangers, for it has long been established that it is necessary to periodically clean these channels in order to maintain the efficiency of operation of the heat exchanger. Of course, it is always possible to shut down the entire system so that the interior channels of the heat exchanger may be scrubbed down and washed out with cleaning liquids. Various mechanical cleaning mechanisms, including chain devices, moving arms, etc. have been used to either scrape the interior surfaces of the flow channels or to develop mechanical shock impact against the channels to vibrate pollutants free from adherence to the channels. Air jet blasts have been used to attempt to blow pollutants free of the channels, and one such device is disclosed in U.S. Pat. No. 4,366,003, issued Dec. 28, 1982. In this device, individual air jets are positioned over the respective inlets of a plurality of pipes, each pipe comprising a heat exchanger pipe through which heated pollutant material flows. The air jets are formed in air pressure lines, and are selectively controllable by valves intermediate the air jets and the pressure lines to sequentially actuate a jet of air into each of the tubes to develop a short term blast of air for propagating down the tubes to remove accumulated pollutants. This device requires relatively complex air valving intermediate the pressure jet openings and the air pressure lines, and although it is suitable for cleaning relatively small diameter pipes, it is not suitable for cleaning plate-type heat exchanger channels because of the limited amount of air volume available for propagating the jets, and because the number of jets are too limited for effective cleaning of an entire channel member.

It is desirable, however, to utilize the principle of air jet blast cleaning in combination with plate-type heat exchangers, for they do provide obvious advantages over mechanical and liquid cleaning systems. Accordingly, the present invention addresses the problem of constructing an air jet wave system which has the requisite operating characteristics to effectively develop a cleaning jet blast sufficient to traverse the entire length of a flow channel constructed between parallel plates in this type of heat exchanger.

SUMMARY OF THE INVENTION

The invention comprises a plate-type heat exchanger having a plurality of elongated rectangular channels constructed between adjacent pairs of heat exchanger plates, the heat exchanger being constructed by sealing off the ends of respective pairs of plates to create elongated channels between such pairs, and to create transverse channels between the pairs of plates so constructed. Adjacent the intake end of such channels is provided a plurality of parrallel pipes, one of such pipes in alignment with each channel, and extending along the length of the pipes is provided a plurality of air jet holes at closely spaced intervals facing the channel. Each of the pipes is connected through a suitable valve closure mechanism to a pressure tank, having a volumetric capacity at least ten times the volume of an individual pipe. A timing mechanism actuator is connected in sequential actuating operation to all of the valve closure members, thereby to provide instantaneous communication of the pressurized volume in the tank to a single pipe, and to continue this actuation in more or less sequential manner. The instantaneous release of the pressurized volume in the tank to one of the pipes, causes an instantaneous, coincidental pressure blast emanating from all of the pressure holes in the pipe, with the net result that a linear pressure wave develops across the entire inlet channel cross section, which causes induction of an additional amount of air, and such wave propagates down the channel at near sonic speed to develop a shock wave for cleaning solid particulate matter from inside the channel.

BRIEF DESCRIPTION OF THE DRAWINGS

The operation and advantages of the invention will become apparent from the appended specification and claims, and with reference to the attached drawings, in which:

DESCRIPTION OF THE PREFERRED EMBODIMENT

Figure 1:
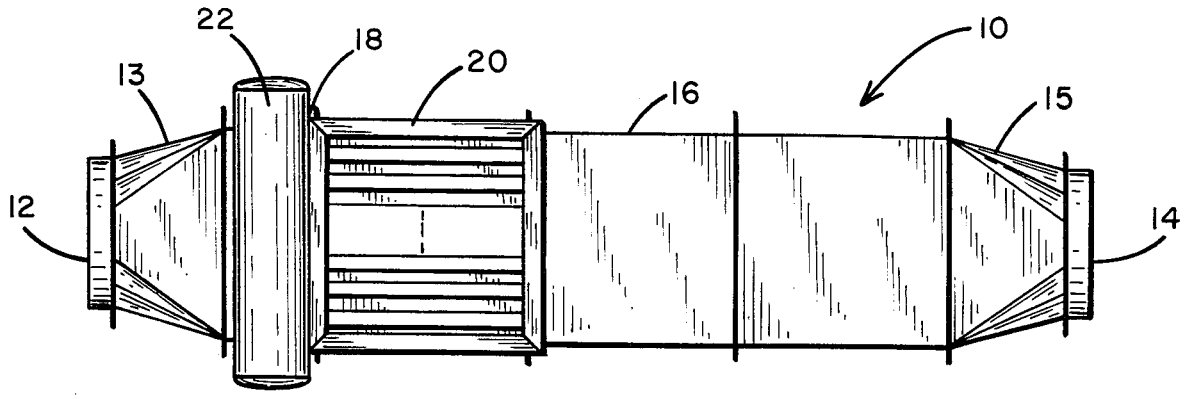
FIG. 1 shows a front elevation view of the invention.

Referring first to FIG. 1 there is shown a heat exchanger 10 in front elevation view. Heat exchanger 10 includes an inlet 12 for receiving hot, dirty gas, and an outlet 14 for exhausting the dirty gas after it has been cooled within the heat exchanger. A housing 16 encloses the heat exchanger 10 in sheet material made from aluminum, steel or similar material. An inlet duct 13 is connected between inlet 12 and housing 16; similarly, an outlet duct 15 is connected between housing 16 and outlet 14. A clean air inlet 20 is formed on one side of housing 16, and a clean air outlet 25 is formed on the other side of housing 16 (see FIG. 2). Intermediate inlet duct 13 and housing 16 are formed in housing 18 for containing the air jet cleaning apparatus to be described herein. A pressure tank 22 is positioned adjacent housing 18, and is in flow communication with the interior of housing 18 via a plurality of jet pipes 24. Each of the jet pipes 24 has a valve 26 intermediate it and pressure tank 22.

Figure 3:
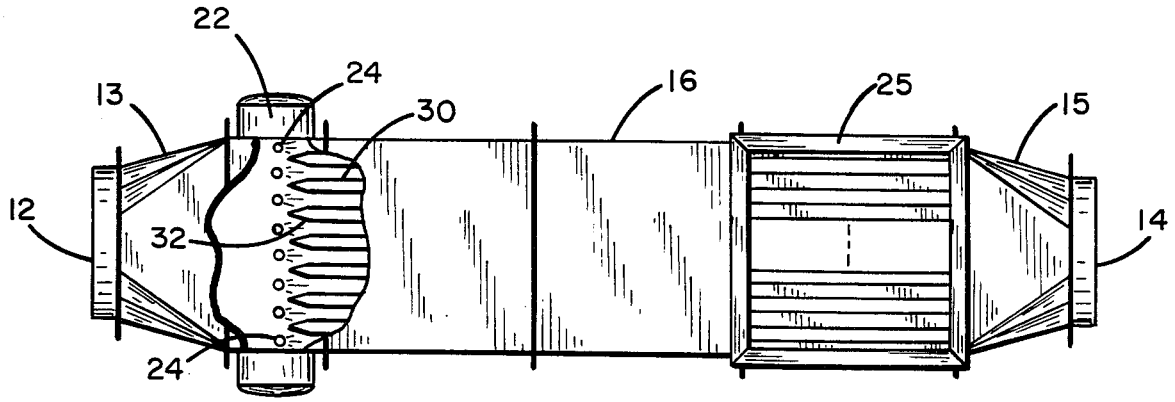
FIG. 3 shows a rear elevation view of the invention in partial breakaway.

FIG. 3 shows a rear elevation view of heat exchanger 10, in partial cutaway. The interior of housing 16 is formed with a plurality of parallel, spaced plates 30. Respective pairs of these plates 30 are connected together by end plates 32, which end plates are preferably formed of two sections having a sharpened intermediate point facing inlet 12 and outlet 14 at their respective ends. The plurality of jet pipes 24 are aligned along the elongated openings created between respective end plates 32, one jet pipe 24 for each opening. The breakaway section of FIG. 3 shows the general construction of adjacent parallel plates 30, together with end plates 32, in alignment with jet pipes 24.

Figure 2:
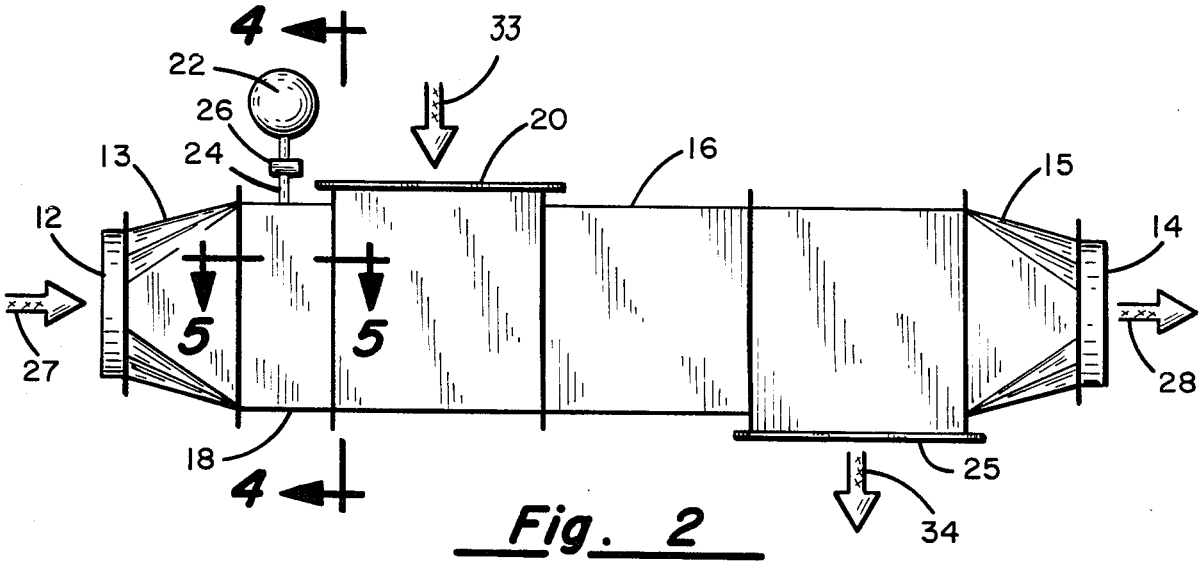
FIG. 2 shows a side elevation view of the invention.

FIG. 2 shows a top view of the invention, illustrating the flow of air therethrough. Arrow 27 indicates the flow of hot dirty gases into inlet 12. The flow of dirty gases progresses along a more or less straight line through housing 16 and emerges from outlet duct 15 as shown by arrow 28. Arrow 28 symbolizes the flow of dirty gases which have been cooled to a reduced temperature from those gases entering at inlet 12. Arrow 33 indicates the inlet flow of clean cool air at inlet 20. This clean air traverses through the interior of housing 16, following a straight path inside of housing 16, which path is normal to the entrance and exit flow paths. Clean air emerges from housing 16 at outlet 25, and is represented by arrow 34. Arrow 34 signifies the flow of clean, warmed air, which has increased in temperature by virtue of the exchange of heat which occurs within housing 16.

The plate heat exchanger construction of housing 16 is in conformance with practices known in the prior art. That is, a plurality of plates are arranged in stacked, parallel alignment throughout housing 16, with respective adjacent pairs of these plates having their ends sealably connected together. This construction yields a plurality of parallel channels between adjacent pairs of sealed plates, the number of channels equal to one-half the number of plates. An inlet opening and exit opening are formed along respective opposite sides of housing 16, thereby exposing the interior parallel plates which traverse housing 16. Adjacent pairs of the plates so exposed are sealably connected together at their edges, to form a plurality of parallel channels intermediate the plates, and also intermediate the plurality of channels formed by sealing together alternate ends of the same plates. After all of the parallel plates are sealed as described hereinabove, the unitary heat exchanger assembly is created, which may then be placed within a housing such as housing 16. This heat exchanger assembly has a plurality of parallel longitudinal channels passing therethrough, and has a plurality of interspaced intermediate parallel channels having an orthonganol air flow entry and exit point relative to the longitudinal channels. The plate sealing process described hereinabove provides a complete seal to prevent contamination of one flow path by the other.

Figure 4:
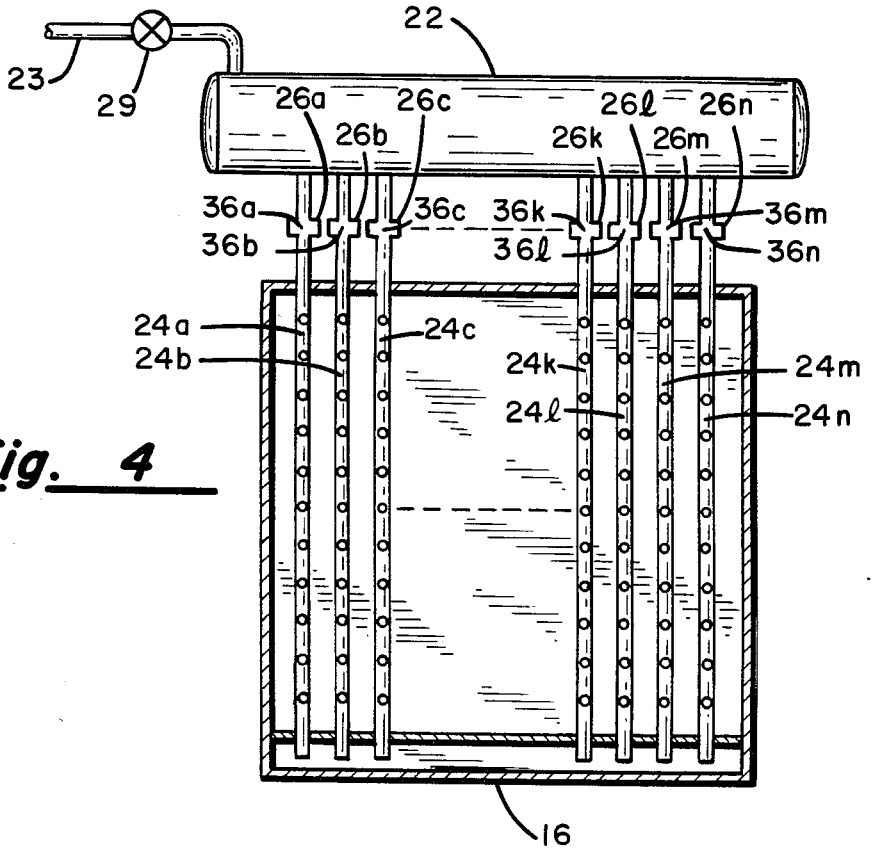
FIG. 4 shows a view taken along the lines 4—4 of FIG. 2.

FIG. 4 shows a view taken along the lines 4—4 of FIG. 2. A plurality of jet pipes 24*a*, 24*b*, 24*c*, . . . 24*n* are arranged in parallel alignment inside housing 16. Each of the jet pipes is aligned so as to be centered relative to an air flow path created between adjacent pairs of heat exchanger plates. Each of the jet pipes 24 has a closed end and a plurality of air jet passages formed along one surface, generally directed inwardly toward the heat exchanger flow paths inside housing 16. These jet passages are preferably holes in the range of ¼ inch–½ inch diameter, spaced apart at approximately 4–6 inch intervals. Jet pipes 24*a*–24*n* are held in parallel, supported relationship inside housing 16, and one end of each of the pipes projects external of housing 16. The projecting end of jet pipes 24*a*–24*n* is respectively connected to a flow control valve 26*a*–26*n*. Each of the flow control valves 26*a*–26*n* is of a type generally available in the industry, as for example valve Model RCA20T, manufactured by Goyen Company. Such flow control valves are actuable by means of remotely generated signals, and are characterized by having a very fast opening and closing response time, in the range of only several milliseconds. Valves 26*a*–26*n* are each connected via a stub inlet pipe to pressure tank 22. Pressure tank 22 is of sufficiently large volume to provide at least ten times the volume of any individual jet pipe 24, it being preferable that pressure tank 22 be also sized to provide at least two cubic feet of tank volume for every ten jet passage openings in a single jet pipe. Pressure tank 22 is supplied with pressurized air via an air line 23, and a air regulator 29 may be used to provide a predetermined pressure level inside of pressure tank 22.

Flow valves 26 may each be actuated by means of a signal on signal lines 36*a*–36*n*, and in the preferred embodiment the flow valves are actuated sequentially by means of sequential actuation of signal lines 36*a*–36*n*. The actuation of a single signal line 36, because of the fast response time for selected valves of this type, very nearly instantaneously provides a flow communication path between a jet pipe 24 and the interior pressurized volume of pressure tank 22.

Figure 5:
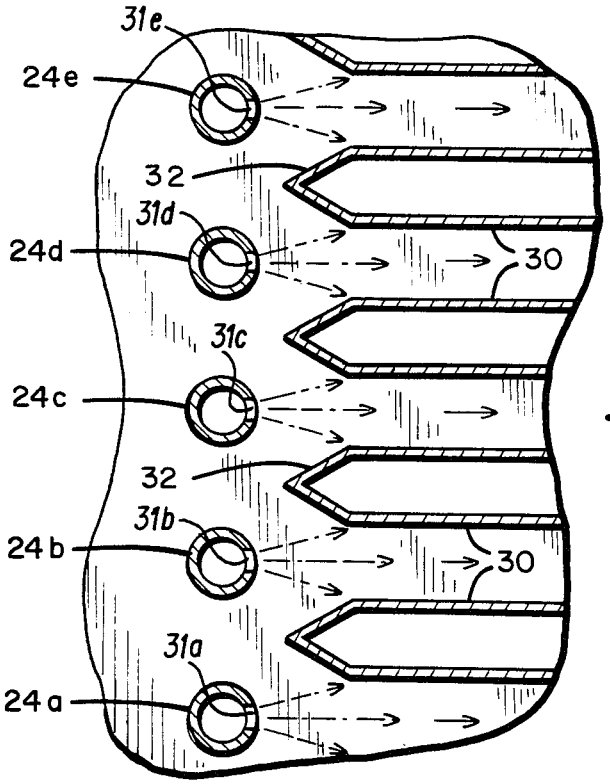
FIG. 5 shows a view taken along the lines 5—5 of FIG. 2.

FIG. 5 shows a cross sectional view taken along the lines 5—5 of FIG. 2. Jet pipes 24*a*, 24*b* and 24*c* are shown in cross sectional view, positioned proximate the ends of plates 30. Each jet pipe is positioned so as to be centered between a pair of open-ended plates 30, and the jet nozzles 31*a*, 31*b*, and 31*c* are facing toward the open-ended area. Each adjacent pair of plates is tapped with an end cap 32 which is sealably fitted between adjacent plates, and projects toward jet pipes 24. End caps 32 form a receiving passage for blasts of air emanating from jet pipes 24, directing the air blasts toward the center open receiving area for conveying between the plates. Each time a blast of air is emanated via nozzles 31, a significant volume of additional air is inducted into the openings created between end caps 32 to create a sudden and abrupt pressure wave which propagates between the channels formed between the plates.

In operation, pressure tank 22 is connected to a high pressure air line capable of providing pressurized air in at least the range of 100–150 psi. The signal lines 36*a*–36*n* to each of the flow control valves 26*a*–26*n* are sequentially actuated, at a sequential rate of one valve every 5–25 seconds. A valve thus actuated is actuated for a time duration in the range of 1/10–2/10 second, during this time period coupling the pressurized volume of pressure tank 22 completely and exclusively into a single jet pipe 24.

Because the volume of pressure tank 22 is selected to be at least ten times larger than the interior volume of any single jet pipe, there results an instantaneous pressure blast into a jet pipe whenever the flow valve is actuated. This instantaneous coupling of a very large pressurized air volume into a jet pipe results in a near sonic jet blast being emitted from each of the air jet passages aligned along the jet pipe. These multiple blasts are instantaneously and simultaneously created, and together with an additional amount of induced air results in a sonic wave of pressurized air forming downstream of the jet pipe, and passing through the air flow channel with which the jet pipe is aligned. This near sonic wave of pressurized air effectively blasts loose particles and other matter adhering to the surface of the heat exchanger plates to dislodge such particles and remove them from the interior of the heat exchanger. After the brief time in which the jet blast is coupled into one of the jet pipes, the pressure system is permitted a recovery time sufficiently long to recharge pressure tank 22 with a complete volume of pressurized air. Therefore, each time the pressure tank is coupled into a single jet pipe it is assured that a full pressure charge is delivered to the jet pipe, thereby insuring that the pressure wave created along the jet pipe is uniform and of maximum instantaneous energy.

The present invention may be embodied in other specific forms without departing from the spirit or essential attributes thereof, and it is therefore desired that the present embodiment be considered in all respects as illustrative and not restrictive, reference being made to the appended claims rather than to the foregoing description to indicate the scope of the invention.

What is claimed is:

1. A plate heat exchanger and cleaning apparatus, comprising (a) a rectangular housing having a plurality of parallel plate heat exchanger channels extending therethrough, said housing having respective open ends to permit gas flow through said channels;

(b) a plurality of pressure pipes positioned adjacent one end of said heat exchanger channels, one pipe being aligned with each of said channels, and each pipe having a plurality of pressure jet openings aligned in facing relationship to said channels;

(c) a controllable pressure relief valve attached to each of said pipes; said pressure relief valve having an opening and closing response time of not more than 1/10 second;

(d) a pressure tank closely positioned to said relief valves, including means for directly coupling said pressure tank to all of said relief valves, said pressure tank having a volume capacity at least ten times greater than the volume capacity of any single pressure pipe;

(e) means for developing a linear pressure wave across the entire open end of each of said parallel heat exchanger channels, including means for discharging substantially the entire pressure volume of said tank into one of said pipes by momentary actuation of the controllable pressure relief valve attached to said pipe for a time duration in the range of 1/10 to 2/10 seconds; and (f) means for selectively actuating each of said pressure relief valves sequentially.

2. The apparatus of claim 1, wherein said pressure pipes each further comprise a closed end distal of said pressure relief valve and a line of jet openings facing said heat exchanger channels, said jet openings being spaced at 3–6 inch intervals.

3. The apparatus of claim 2, wherein said jet openings further comprise holes having a diameter from $\frac{1}{4}$ inch to $\frac{1}{2}$ inch each.

4. The apparatus of claim 3, wherein said pressure tank volume is at least 2 cubic feet for every 10 jet openings along a single pipe.

5. The apparatus of claim 4, wherein said means for selectively actuating said pressure relief valves further comprises a timer capable of actuating at intervals of 5–25 seconds.

* * * * *